US011408184B2

(12) United States Patent
Bunch et al.

(10) Patent No.: US 11,408,184 B2
(45) Date of Patent: Aug. 9, 2022

(54) TILE SPACING DEVICE AND ACCOMPANYING SYSTEM AND METHOD

(71) Applicants: Clinton D. Bunch, Keller, TX (US); Joshua A. Bunch, Keller, TX (US)

(72) Inventors: Clinton D. Bunch, Keller, TX (US); Joshua A. Bunch, Keller, TX (US)

(73) Assignee: Acufloor, LLC, North Richland Hills, TX (US)

( * ) Notice: Subject to any disclaimer, the term of this patent is extended or adjusted under 35 U.S.C. 154(b) by 64 days.

(21) Appl. No.: 17/032,500

(22) Filed: Sep. 25, 2020

(65) Prior Publication Data

US 2021/0010279 A1 Jan. 14, 2021

Related U.S. Application Data

(63) Continuation of application No. 15/871,434, filed on Jan. 15, 2018, now Pat. No. 10,787,824.

(60) Provisional application No. 62/446,756, filed on Jan. 16, 2017.

(51) Int. Cl.

| | |
|---|---|
| ***E04F 21/00*** | (2006.01) |
| ***E04F 13/08*** | (2006.01) |
| ***E04F 15/02*** | (2006.01) |

(52) U.S. Cl.

CPC ..... *E04F 21/0092* (2013.01); *E04F 13/0889* (2013.01); *E04F 15/02005* (2013.01)

(58) Field of Classification Search

None

See application file for complete search history.

(56) References Cited

U.S. PATENT DOCUMENTS

| | | | | |
|---|---|---|---|---|
| 4,793,068 | A * | 12/1988 | Golkar | E04F 21/0092 33/518 |
| 4,953,341 | A * | 9/1990 | Joos | E01C 5/006 33/404 |
| 5,201,130 | A | 4/1993 | Krchnak | |
| 5,288,534 | A | 2/1994 | Tavshanjian | |
| D492,210 | S | 6/2004 | Shilo et al. | |
| 6,769,191 | B1 | 8/2004 | Zusman | |
| 6,823,640 | B1 | 11/2004 | Pytlewski | |
| 6,874,242 | B2 | 4/2005 | Shilo et al. | |
| 7,257,926 | B1 | 8/2007 | Kirby | |
| 7,536,802 | B1 | 5/2009 | Tavy et al. | |
| 7,698,831 | B2 | 4/2010 | Higgs et al. | |
| 8,205,348 | B2 | 6/2012 | Baros et al. | |
| 8,720,143 | B2 | 5/2014 | Noutsis | |
| 9,121,187 | B1 | 9/2015 | Bunch | |
| 10,538,924 | B2 * | 1/2020 | Anderson | E04F 21/0092 |

(Continued)

FOREIGN PATENT DOCUMENTS

| | | |
|---|---|---|
| CA | 2885090 | 2/2016 |
| EP | 1111157 | 6/2001 |

*Primary Examiner* — Christopher W Fulton

(74) *Attorney, Agent, or Firm* — Scott Griggs; Griggs Bergen LLP

(57) ABSTRACT

A tile spacing device and accompanying system and method are disclosed for spacing multiple tiles. In one embodiment, a central body has four arms extending therefrom with a releasably frangible connection. Each of the four arms has a cellular sheet structure defined by multiple cells, including at least one hexagonal cell. The central body and the four arms provide a four-tile engagement configuration. By selectively breaking and removing an arm, a three-tile engagement configuration may also be provided.

16 Claims, 2 Drawing Sheets

(56) References Cited

U.S. PATENT DOCUMENTS

| | | | |
|---|---|---|---|
| 10,787,824 | B2 | 9/2020 | Bunch |
| 2004/0250435 | A1 | 12/2004 | Fiore |
| 2005/0214502 | A1 | 9/2005 | Westthorp |
| 2007/0011898 | A1 | 1/2007 | Frank et al. |
| 2013/0212974 | A1 | 8/2013 | Sullivan |
| 2015/0233129 | A1 | 8/2015 | Gamisans Berenguer et al. |

* cited by examiner

TILE SPACING DEVICE AND ACCOMPANYING SYSTEM AND METHOD

PRIORITY STATEMENT & CROSS-REFERENCE TO RELATED APPLICATION

This application is a continuation of U.S. patent application Ser. No. 15/871,434 entitled "Tile Spacing Device and Accompanying System and Method," filed Jan. 15, 2018, in the names of Clinton D. Bunch et al. and issued as U.S. Pat. No. 10,787,824 on Sep. 29, 2020; which claims priority from U.S. Patent Application Ser. No. 62/446,756, entitled "Tile Spacing Device and Accompanying System and Method," and filed on Jan. 16, 2017, in the names of Clinton D. Bunch et al.; both of which are hereby incorporated by reference, in entirety, for all purposes.

TECHNICAL FIELD OF THE INVENTION

This invention relates, in general, to tile installation and, in particular, to a device for aligning tiles and properly spacing tiles during the installation thereof, and an accompanying system and method.

BACKGROUND OF THE INVENTION

Tile has become a popular decorative and functional article for use in floors, walls, countertops, and the like. Both professional tile installers and do-it-yourselfers spend a great deal of time aligning and spacing tiles as they are being placed on a substrate's surface. Proper alignment and spacing of each tile is important for a number of reasons. Improper installation can cause the need for tiles to be replaced in order to prevent a spacing error from propagating across the substrate, aesthetic reasons, and in some instances, safety concerns. A need exists for a device for aligning and properly spacing tiles.

SUMMARY OF THE INVENTION

It would be advantageous to achieve a device for aligning and properly spacing tiles. It would also be desirable to enable a mechanical-based solution that furnishes an inexpensive tool that assists professional tile installers and do-it-yourselfers. To better address one or more of these concerns, in one aspect of the invention, a tile spacing device and accompanying system and method are disclosed for spacing tiles. In one embodiment of the tile spacing device, a central body has four arms extending therefrom with a releasably frangible connection. Each of the four arms has a cellular sheet structure defined by multiple cells, including at least one hexagonal cell. The central body and the four arms provide a four-tile engagement configuration. By selectively breaking and removing an arm, a three-tile engagement configuration may also be provided. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1:
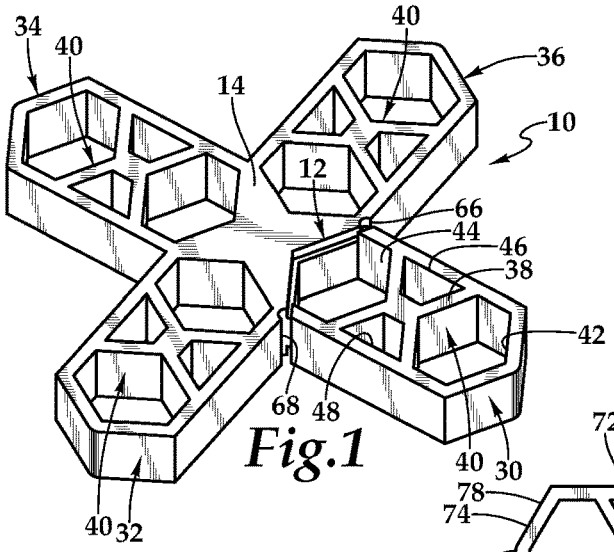
FIG. 1 is a front perspective view of one embodiment of a tile spacing device for spacing tiles according to the teachings presented herein.
Figure 2:
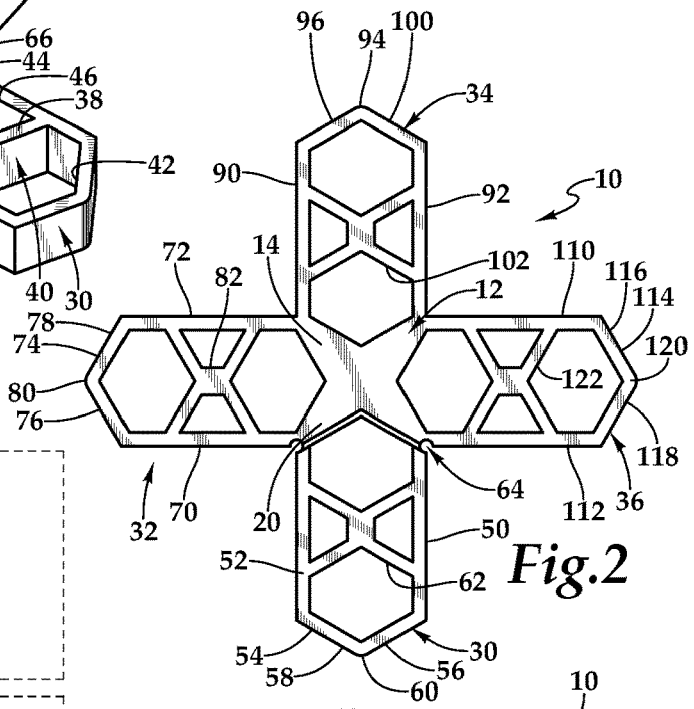
FIG. 2 is a top plan view showing the tile spacing device depicted in FIG. 1, the tile spacing device having top-bottom mirror symmetry.
Figure 3:
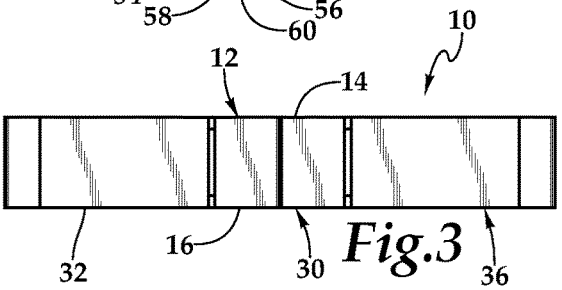
FIG. 3 is a side elevation view showing the tile spacing device depicted in FIG. 1.

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Referring initially to FIG. 1 through FIG. 4, therein is depicted one embodiment of a tile spacing device that is schematically illustrated and generally designated 10. The tile spacing device 10 may be utilized for spacing tiles and the tile spacing device 10 includes a central body 12 having an upper surface 14, a lower surface 16, and a sidewall 18 therearound. The sidewall 18 may have substantially the same contour as the tiles such that the sidewall 18 compliments the tiles in side-surface-to-surface engagement. The upper surface 14, the lower surface 16, and the sidewall 18 of the central body 12 may provide subterminal opposition surfaces in which palmar surfaces of a thumb and an index finger can hold the tile spacing device 10 therebetween. Further, in one implementation, the central body 12 may have a four-pointed star shape 20.

In one embodiment, four arms 30, 32, 34, 36 are disposed on and extend from the central body 12 in a coplanar relationship with the central body 12. Each of the four arms 30, 32, 34, 36 includes a cellular sheet structure 38 defined by multiple cells 40, where at least one or two of the multiple cells 40 may be hexagonal cells, such as hexagonal cells 42, 44. Additionally, at least one or two of the multiple cells may be trapezoidal cells, such as trapezoidal cells 46, 48. The arms 30, 32, 34, 36 provide a spacer width furnishing a finished grout line space, where the width of the space may be 1/32 inches, 1/16 inches, 1/8 inches, 3/16 inches, or 1/4 inches, for example. The arms 30, 32, 34, 36 may also provide subterminal opposition surfaces in which palmar surfaces of a thumb and an index finger can hold the tile spacing device 10 therebetween.

Arm 30 includes parallel outer walls 50, 52 joined by a third wall 54, which is depicted as being two angled wall portions 56, 58 defining a tip 60. Multiple interior partitions 62 define the multiple cells 40. A releasably frangible connector 64 couples the arm 30 to the central body 12. As depicted, the releasably frangible connector 64 may be a pair of tabs 66, 68 positioned at the intersection of the central body 12 and the arm 30. Alternatively, by way of further example, the releasably frangible connector 64 may include a quartet of notches positioned at the intersection of the central body 12 and the arm 30. It should be appreciated that the structure of the releasably frangible connector 64 may vary depending on manufacturing technique employed, for example. As will be discussed in more detail hereinbelow, the arm 30 may be removed from the central body 12 so that the tile spacing device 10 may shift from accommodating four tiles to accommodating three tiles.

An arm 32 includes parallel outer walls 70, 72 joined by a third wall 74, which is depicted as being two angled wall portions 76, 78 defining a tip 80. Multiple interior partitions 82 define the multiple cells 40. An arm 34 includes parallel outer walls 90, 92 joined by a third wall 94, which is depicted as being two angled wall portions 96, 98 defining a tip 100. Multiple interior partitions 102 define the multiple cells 40. An arm 36 includes parallel outer walls 110, 112 joined by a third wall 114, which is depicted as being two angled wall portions 116, 118 defining a tip 120. Multiple interior partitions 122 define the multiple cells 40. As illustrated, the arms include four-fold rotational symmetry about the central body and top-bottom symmetry. It should be appreciated that the arms 30, 32, 34, 36 may include variations in cellular sheet structure. Further, it should be appreciated that one or more of the arms 30, 32, 34, 36 may include a releasably frangible connector as well.

Figure 5A:
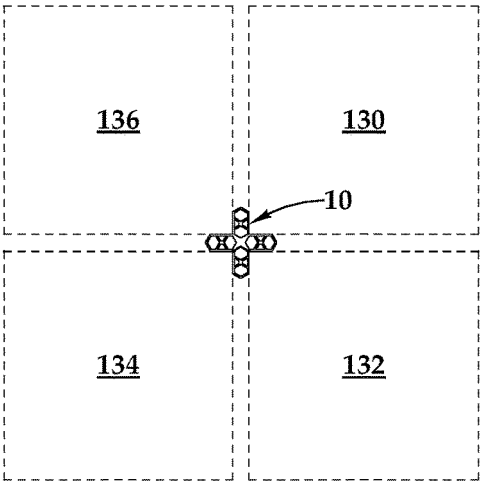
FIG. 5A is a top plan view of one embodiment of the tile spacing device being utilized to align and space four tiles.
Figure 4:
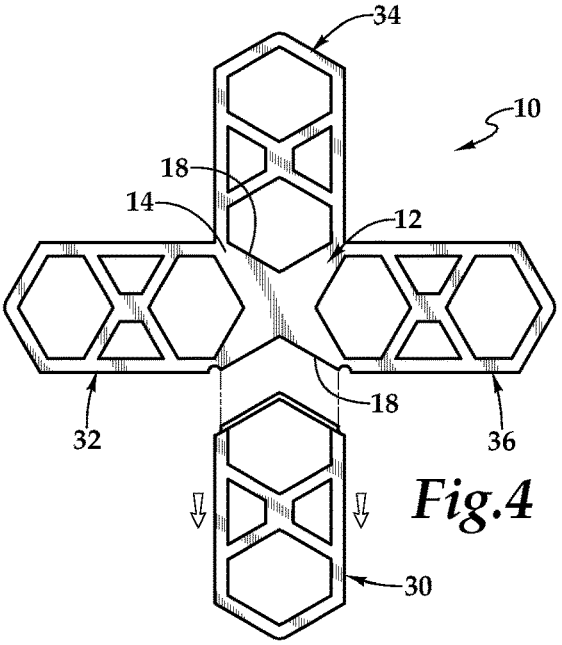
FIG. 4 is a front perspective view of the tile spacing device depicted in FIG. 1 showing one embodiment of an arm being selectively broken from a central body of the tile spacing device.
Figure 5B:
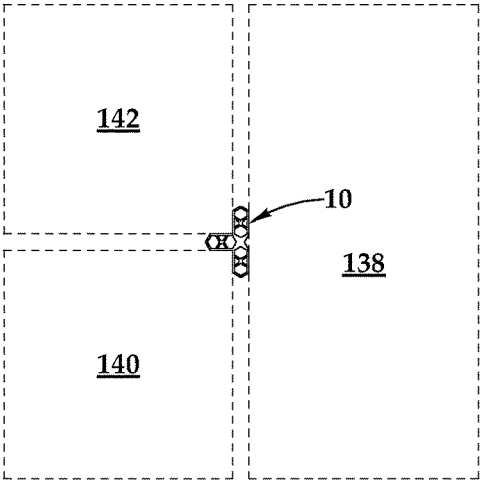
FIG. 5B is a top plan view of one embodiment of the tile spacing device being utilized to align and space three tiles.

Referring now to FIG. 5A and FIG. 5B, in one implementation, the arms 30, 32, 34, 36 are spaced at approximately 0, 90, 180, and 270 degrees with respect to each other. Each of the arms 30, 32, 34, 36 are configured to engage tiles in a flush engagement and the four arms 30, 32, 34, 36, in combination, cooperate to engage four tiles 130, 132, 134, 136 simultaneously. With arm 30 removed, the arms 32, 34, 36 are configured to engage three tiles 138, 140, 142 simultaneously. The subterminal opposition surfaces defined by upper surface 14, the lower surface 16, sidewall 18, and each of the arms 30, 32, 34, 36 provide the length and breadth required for gripping the tile spacing device 10 for insertion and removal during a tile spacing and alignment process.

It should be appreciated that the tile spacing device 10 is not limited to use with floor tiles. As used herein, the tiles may be traditional thin rectangular slabs of baked clay, concrete, or other material for covering floors or, more generally, substrates of any material including wood, finishing boards, or metal or the like used to cover a substrate, such as a horizontal surface or a vertical surface, such as a wall.

As discussed, both professional tile installers and do-it-yourselfers spend a great deal of time aligning and leveling tiles as they are being placed on a substrate's surface. Proper alignment and leveling of each tile is important for a number of reasons. Improper installation can cause the need for tiles to be replaced in order to prevent a spacing error from propagating across the substrate, aesthetic reasons, and in some instances, safety concerns. The tile spacing device and teachings presented herein provide a single spacing device that with a simple rotation of the device can be used to align and space two, three or four tiles.

Figure 6:
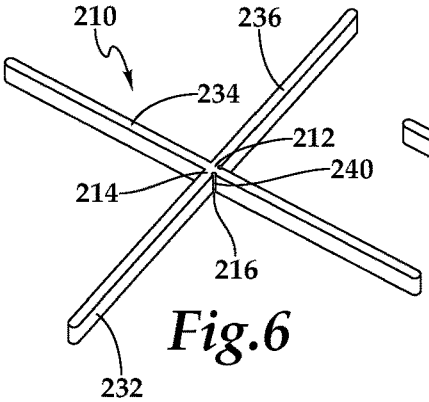
FIG. 6 is a front perspective view of another embodiment of a tile spacing device, according to the teachings presented herein.
Figure 7:
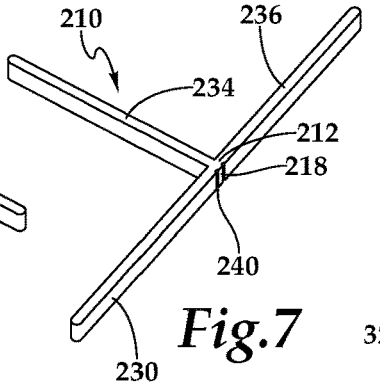
FIG. 7 is a front perspective view of the tile spacing device depicted in FIG. 6 showing one embodiment of an arm being selectively broken from a central body of the tile spacing device.
Figure 12:
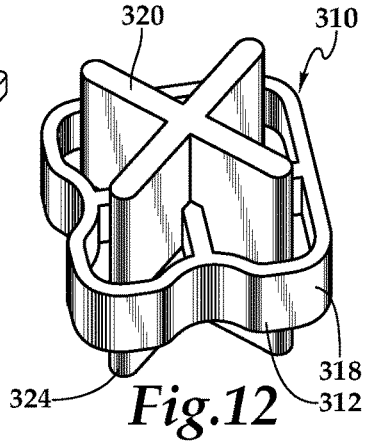
FIG. 12 is a front perspective view of the tile spacing tool depicted in FIG. 8.
Figure 8:
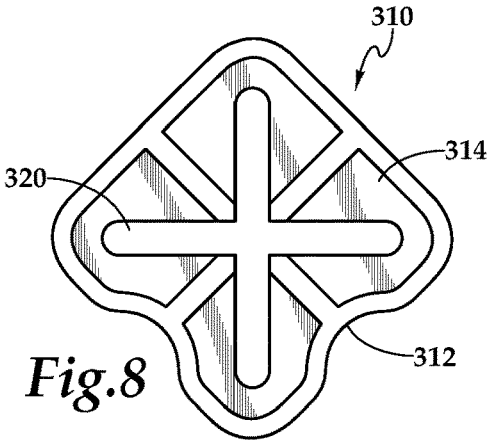
FIG. 8 is a top plan view of one embodiment of a tile spacing tool for use with the tile spacing device, according to the teachings presented here.
Figure 9:
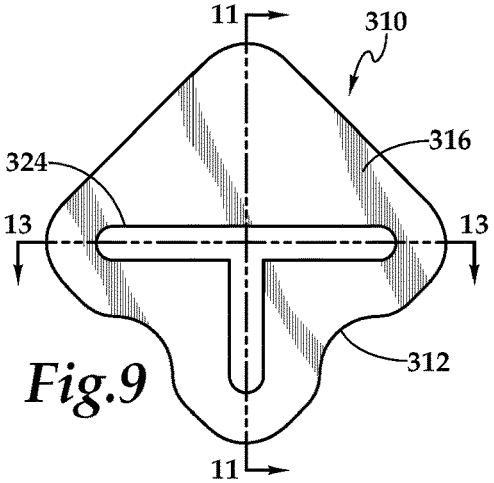
FIG. 9 is a bottom plan view of the tool spacing tool depicted in FIG. 8.
Figure 10:
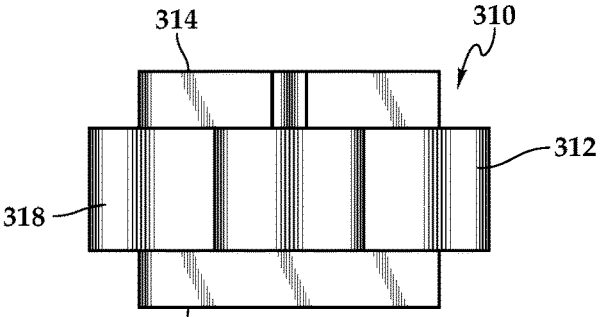
FIG. 10 is a side elevation view of the tile spacing tool depicted in FIG. 8.
Figure 11:
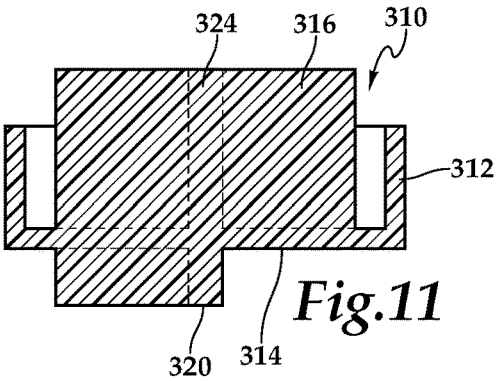
FIG. 11 is a cross-sectional view of the tile spacing tool depicted in FIG. 8.

Referring now to FIGS. 6 and 7, another embodiment of a tile spacing device 210 is depicted, which includes a central body 212 having an upper surface 214, a lower surface 216, and a sidewall 218 therearound. The sidewall 218 may have substantially the same contour as the tiles such that the sidewall 218 compliments the tiles in side surface-to-surface engagement. The upper surface 214, the lower surface 216, and the sidewall 218 of the central body 212 may provide subterminal opposition surfaces in which palmar surfaces of a thumb and an index finger can hold the tile spacing device 210 therebetween. In one embodiment, four arms 230, 232, 234, 236 are disposed on and extend from the central body 212 in a coplanar relationship with the central body 212. The arms 230, 232, 234, 236, which may be at least substantially solid, provide a spacer width furnishing a finished grout line space, where the width of the space may be 1/32 inches, 1/16 inches, 1/8 inches, 3/16 inches, or 1/4 inches, for example. The arms 230, 232, 234, 236 may also provide subterminal opposition surfaces in which palmar surfaces of a thumb and an index finger can hold the tile spacing device 210 therebetween. A releasably frangible connector 240 couples the arm 230 to the central body and the arm 230 may be broken off to configure the tile spacing device 210 from a four-tile configuration to a three-tile configuration.

Figure 13:
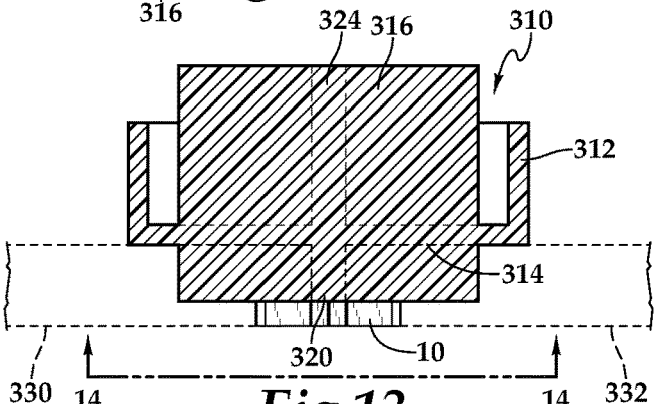
FIG. 13 is a side cross-sectional view of the tile spacing tool depicted in FIG. 8 being utilized to position a tile spacing device.
Figure 14:
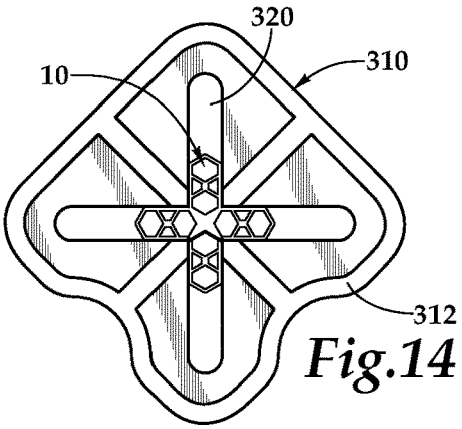
FIG. 14 is a bottom plan view of the tile spacing tool and tile spacing device depicted in FIG. 13.

Referring now to FIG. 8 through FIG. 14, one embodiment of a tile spacing tool 310 for use with a tile spacing device, such as tile spacing device 10 or tile spacing device 210, is depicted. The tile spacing tool 310 may be utilized for positioning the tile spacing device 10 between three for four tiles and includes a central body 312 having an upper surface 314, a lower surface 316, and a sidewall 318 therearound. A cross-shaped engagement surface 320 extends from the upper surface 314 of the tile spacing tool 310. The cross-shaped engagement surface 320 has a shape corresponding to the tile spacing device 10 with the four arms 30, 32, 34, 36 or similarly the tile spacing device 210. A T-shaped engagement surface 324 extends from the lower surface 316 of the tile spacing tool 310. The T-shaped engagement surface 324 has a shape corresponding to the tile spacing device 10 or the tile spacing device 210 in the three-tile engagement configuration. As shown in FIG. 13, with the four-tile engagement as an illustrative example, the cross-shaped engagement surface 320 of the tile spacing tool 300 is being utilized to position the tile spacing device 10 between four tiles, including tiles 330, 332.

As previously discussed, the tile spacing device 10 and systems and accompanying systems and methods presented herein may assist both professional tile installers and do-it-yourselfers. By way of example, in some circumstances, during an installation, it may be desirable for a spacer, such as the instant tile spacing device, to remain in the installation and become a permanent surface. The tile spacing device 10 presented herein may be used as such a "leave-in" style spacer.

Some of the benefits of the "leave-in" spacers include elimination of the need to remove spacers, which may sometimes be a difficult and time consuming process for the installers. Leave-in spacers can also allow for grouting of the installation before the mortar is completely set as leave-in spacers stabilize the tiles and keep the tiles from moving while the mortar is wet. In some circumstances, the leave-in spacers may even prevent a floor from becoming out of alignment if someone walks across the floor while the mortar is still soft and moveable.

In one leave-in spacer implementation, the tile spacing devices presented herein are constructed of a largely hollow construction, such as the cellular sheet structure discussed hereinabove, in order to allow for the grout to cure equally with the surrounding joints and thus to prevent discoloring which can sometimes occur. For example, if the spacer were made from solid plastic, it would dry slower than the surrounding mortar joints which are more absorbent. This can often produce grout discoloration. In the much smaller pieces, say 1/16" and 1/32", the tile spacing devices may be solid and still cure properly because the joints are so small that drying properties derive from the tile edges and air flow much more than the mortar bed below.

Leave-in style spacers, however, are not without problems. Leave in style spacers have two basic problem if the installer is not extremely careful and attentive. First, if the spacer is not placed deep enough between the tiles, the spacer may create discoloration and can even show thru the installation. This is often difficult to see as grouting is in-progress, but can be seen after grouting. When the grout is hardened, this mistake can produce lots of repairs that are very time consuming and sometimes still discolor the grout with the subsequent patches. Second, while trying to prevent the first problem, the installer may, and often does push the spacer in too far because the tool they are using to push them in is most often some sort of trowel without any stop points. This would push the spacer down too far into the mortar bed, past the tile edges, and the effectiveness of the spacer would disappear. Pushing in the spacer too far can easily affect the alignment of the entire project, but certainly would affect the nearby tiles because the assembly would no longer be completely holding its position.

Two basic patterns of tile installations exist. The "grid pattern" or the "offset pattern". The grid pattern for a leave-in style spacer would require a "cross style" spacer, whereas the offset pattern would requires "T style" spacer. Historically tile installers must purchase both of these style spacers for each joint size and an installer frequently is in need of one or the other before the job is finished. By way of example, the installer may have lots of grid (cross) spacers in their bucket but during the install have discovered they have run out of "T style" spacers for the offset joints in the floor. The installer is left with the choice of going back to the tile supply to purchase more spacers, or by using spacers in the more traditional way of three exterior facing spacers per intersection, or creating some method of cutting one leg off of the available cross style spacers. All options are more time consuming, but the cutting option can even create misalignment due to small remaining dots of plastic that remain after the cut which can widen the joint in an undesirable way.

The tile spacing tool 310 addresses these concerns about leave-in style spacers. In one embodiment, the tile spacing tool 310 creates a leg that can be smoothly and easily removed from the cross-style presentation to provide the needed "T style" presentation. As the vendor and the installer desire to purchase only one style of spacer for each size joint, the tile spacing tool 310 satisfies this desire. For example, the installer or vendor would need to keep only 5 products for the 5 sizes of 1/32 inches, 1/16 inches, 1/8 inches, 3/16 inches, and 1/4 inches. Without the tile spacing tool 310, both the vendors and the installers would have to inventory 10 products to handle the different patterns for each size joint, 5 of the cross style and 5 of the T style. To handle the above problem of installing the spacer depth properly, the tile spacing tool 310 is a spacer setting tool which easily pushes the spacer to the exact optimum depth (not too shallow and not too deep). As shown in FIG. 8 through FIG. 14, to handle both basic tile patterns, the spacer setting tool has the appropriate protrusions on either side of the body.

The order of execution or performance of the methods and steps illustrated and described herein is not essential, unless otherwise specified. That is, elements of the methods and steps may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A tile spacing device for spacing a plurality of tiles, the tile spacing device comprising:

a central body providing subterminal opposition surfaces in which palmar surfaces of a thumb and an index finger can hold the tile spacing device therebetween;

first, second, third, and fourth arms extending from the central body, the first, second, third, and fourth arms being coplanar with the central body and set at right angles with respect to each other;

each of the first, second, third, and fourth arms including a cellular sheet structure defined by a plurality of cells;

a releasably frangible connector coupling the first arm to the central body, the releasably frangible connector having a vertically extending notch at the intersection of the first arm and the central body, the releasably frangible connector having a horizontally extending notch at the intersection of the first arm and the central body;

the central body and the first, second, third, and fourth arms being a four-tile engagement configuration; and the central body and the second, third, and fourth arms being a three-tile engagement configuration following the frangible release of the first arm from the central body.

2. The tile spacing device as recited in claim 1, wherein the central body further comprises a four-pointed star shape.

3. The tile spacing device as recited in claim 1, wherein each of the first, second, third, and fourth arms further comprise:

parallel first and second outer walls joined by a third wall; and a plurality of interior partitions defining the plurality of cells.

4. The tile spacing device as recited in claim 1, wherein the first, second, third, and fourth arms further comprise a spacing at approximately 0, 90, 180, and 270 degrees with respect to each other.

5. The tile spacing device as recited in claim 1, wherein each of the first, second, third, and fourth arms each comprise a spacer width providing a finished grout line space.

6. The tile spacing device as recited in claim 1, wherein each of the first, second, third, and fourth arms each comprise a width selected from the group consisting of 1/32 inches, 1/16 inches, 1/8 inches, 3/16 inches, and 1/4 inches.

7. The tile spacing device as recited in claim 1, wherein the plurality of cells further comprise at least one hexagonal cell.

8. The tile spacing device as recited in claim 1, wherein the plurality of cells further comprise at least two hexagonal cells.

9. The tile spacing device as recited in claim 1, wherein the plurality of cells further comprise at least one trapezoidal cell.

10. The tile spacing device as recited in claim 1, wherein the plurality of cells further comprise at least two trapezoidal cells.

11. The tile spacing device as recited in claim 1, wherein the central body, the first arm, and the second arm cooperate to provide flush engagement of a tile.

12. The tile spacing device as recited in claim 1, wherein the first, second, third, and fourth arms further comprise four-fold rotational symmetry about the central body.

13. The tile spacing device as recited in claim 1, wherein the first, second, third, and fourth arms and the central body further comprise top-bottom symmetry.

14. A tile spacing device for spacing a plurality of tiles, the tile spacing device comprising:

a central body providing subterminal opposition surfaces in which palmar surfaces of a thumb and an index finger can hold the tile spacing device therebetween;

first, second, third, and fourth arms extending from the central body, the first, second, third, and fourth arms being coplanar with the central body and set at right angles with respect to each other;

each of the first, second, third, and fourth arms including a cellular sheet structure defined by a plurality of cells;

the first arm including parallel first and second outer walls joined by a third wall and a plurality of interior partitions defining the plurality of cells;

a releasably frangible connector coupling the first arm to the central body, the releasably frangible connector having a first vertically extending notch at the intersection of the first outer wall and the central body, the releasably frangible connector having a second vertically extending notch at the intersection of the second outer wall and the central body;

the releasably frangible connector includes a first horizontally extending notch at the intersection of the first arm and the central body and a second horizontally extending notch at the intersection of the first arm and the central body, the second horizontally extending notch being opposite, with respect to the central body, to the first horizontally extending notch;

the central body and the first, second, third, and fourth arms being a four-tile engagement configuration; and the central body and the second, third, and fourth arms being a three-tile engagement configuration following the frangible release of the first arm from the central body.

15. The tile spacing device as recited in claim 14, wherein the central body, the first arm, and the second arm cooperate to provide flush engagement of a tile.

16. The tile spacing device as recited in claim 14, wherein the plurality of cells further comprise a structure selected from the group consisting of at least one hexagonal cell, two hexagonal cells, at least one trapezoidal cell, and at least two trapezoidal cells.

* * * * *